US006945843B1

(12) United States Patent
Motosko

(10) Patent No.: US 6,945,843 B1
(45) Date of Patent: Sep. 20, 2005

(54) TOY LOWRIDER MODEL VEHICLE

(76) Inventor: Stephen J. Motosko, 132 Sand Dollar La., Sarasota, FL (US) 34242

( * ) Notice: Subject to any disclaimer, the term of this patent is extended or adjusted under 35 U.S.C. 154(b) by 0 days.

(21) Appl. No.: 10/833,703

(22) Filed: Apr. 28, 2004

(51) Int. Cl.[7] ..... A63H 17/00

(52) U.S. Cl. ..... 446/437; 446/456; 446/457; 446/466

(58) Field of Search ..... 446/454, 456, 446/457, 460, 465, 466, 468, 471, 431, 437, 446/470; 280/6.15, 6.157, 5.5, 5.514

(56) References Cited

U.S. PATENT DOCUMENTS

| | | | | |
|---|---|---|---|---|
| 2,600,462 | A * | 6/1952 | Bateman | 280/6.15 |
| 5,108,126 | A | 4/1992 | Banse | |
| 5,334,077 | A | 8/1994 | Bailey | |
| 5,338,246 | A | 8/1994 | Suto | |
| 5,482,494 | A | 1/1996 | Ishimoto | |
| 5,527,059 | A * | 6/1996 | Lee, Jr. | 446/466 |
| 5,722,872 | A | 3/1998 | Simmons et al. | |
| 5,785,576 | A * | 7/1998 | Belton | 446/456 |
| 6,383,054 | B1 * | 5/2002 | Rauch | 446/456 |
| 6,478,655 | B2 * | 11/2002 | Wu | 446/456 |
| 6,565,412 | B1 * | 5/2003 | Thrasher | 446/465 |
| 6,599,169 | B2 | 7/2003 | Edmisson | |
| 6,620,023 | B2 | 9/2003 | Yeung | |
| 6,758,719 | B1 * | 7/2004 | Nava | 446/466 |
| 6,767,272 | B2 * | 7/2004 | Santarsiero | 446/466 |

* cited by examiner

*Primary Examiner*—Bena Miller
(74) *Attorney, Agent, or Firm*—Charles J. Prescott

(57) ABSTRACT

A toy lowrider model vehicle which simulates the lifting and lowering movement of a full-size lowrider vehicle. The toy vehicle, preferably wireless or remote controlled having an onboard control signal receiver and battery power, has a chassis which supports spaced front and rear suspension assemblies each including a transverse axle supporting a wheel thereon for rotation and chassis support. Each suspension assembly is preferably independently movable, carrying an axle and wheel thereon for controlled up and down movement to selectively raise and lower each corner of the chassis separately or in any desired combination together. Lifting motors supported on the chassis each include an output shaft connected to one corresponding suspension assembly whereby the corresponding axle and wheel thereon are carried to move up or down to effect the corresponding corner of the chassis to raise or lower in lowrider fashion. A drive motor rotatably drives at least one axle and wheel carried thereon to propel the toy vehicle. A steering motor preferably is also provided to selectively steer the front wheels.

3 Claims, 5 Drawing Sheets

TOY LOWRIDER MODEL VEHICLE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to model or toy vehicles, and more particularly to a remote controlled model vehicle with simulated lowrider type motion control.

2. Description of Related Art

Model or toy cars are very popular and are produced to simulate or emulate a real vehicle albeit in reduced scale or exaggerated form. One relatively new area of model car products is with respect to remote controlled toy vehicles which may be propelled at various speeds and are rendered steerable by wireless components controlled by an independent radio transmitter.

An area of full size vehicle emulation as embodied in toy vehicles is that of a lowrider vehicle with "hip hop" suspension which simulates the hip hop raising and lowering motions that are well known to be associated with full-size lowrider vehicles. Fluid actuation mechanisms installed onto full scale vehicles rapidly raise and lower all or a selected number of suspension assemblies at each corner area of the full scale vehicle so that it may be raised in total, lowered close to the ground and raised and lowered rapidly from front to back or from side to side or from corner to corner as the operator of such vehicles desires.

A number of prior art patents disclose miniature or toy self-propelled vehicles, mostly operable by remote or wireless controller which emulate this lowrider motion activity:

U.S. Pat. No. 6,620,023 to Yeung
U.S. Pat. No. 6,383,054 to Rauch
U.S. Pat. No. 5,722,872 to Simmons, et al.
U.S. Pat. No. 5,785,576 to Belton
U.S. Pat. No. 5,334,077 to Bailey
U.S. Pat. No. 6,599,169 to Edmisson, et al.
U.S. Pat. No. 5,338,246 to Suto
U.S. Pat. No. 5,108,126 to Banse
U.S. Pat. No. 5,482,494 to Ishimoto More specifically, the Yeung patent 6,620,023, teaches a tilt and lift suspension for a model vehicle which emulates "hydraulics" in a full size vehicle. A wheel carriage is coupled to the chassis and movement therebetween is controlled by one or more actuators.

The articulated model vehicle disclosed in the '054 patent by Rauch also teaches a model vehicle having a lowrider configuration with independently repositionable roadway wheels into temporary roadway wheel hop positions.

Simmons, in U.S. '872, incorporates a counterbalance lift assembly to achieve a lowrider model suspension action. Lifting action is accomplished by a solenoid acting on an L-shaped lever arm to cause the rise and fall of the front suspension simulating a lowrider hopping action.

At least one hopping actuating motor is mounted on a frame and has a second rotatable arm connectable to the front axle as taught in U.S. Patent '576 by Belton. A simplistic lift assembly for lowrider model cars is taught by Bailey in U.S. Patent '077 wherein a lifting assembly is provided on the chassis for lifting the chassis relative to the axle between a lowered position and a raised position to simulate lowrider type movement. Both front and back and side-to-side hopping movement is achievable.

The present invention provides a toy lowrider model vehicle with very realistic suspension and actuator components. Each of the independent suspension assemblies function similarly to that of a full scale vehicle having upper and lower control arms which are pivotally connected to the chassis and an axle or spindle which extends transversely outwardly to support a wheel. The front suspension also includes a steering mechanism with independent steering motor to effect direction control of the vehicle. Moreover, each of the independent suspension assemblies is controlled in vertical movement of the wheel axle or spindle by a separate lifting motor which moves only through a limited arc of travel which, by pivoted linkage, is connected to one of the suspension assembly control arms, preferably the lower control arm.

By this arrangement, a fully functioning steerable radio controlled or manually controlled toy lowrider model vehicle, preferably in a larger 1:6 scale, may be selectively raised and lowered to achieve virtually any combination of lifting and lowering in lowrider vehicle fashion while also providing the satisfaction and pleasure of operation of a scaled down version of a full scale vehicle.

BRIEF SUMMARY OF THE INVENTION

This invention is directed to a toy lowrider model vehicle which simulates the lifting and lowering movement of a full-size lowrider vehicle. The toy vehicle, preferably wireless or remote controlled having an onboard control signal receiver and battery power, has a chassis which supports spaced front and rear suspension assemblies each including a transverse axle supporting a wheel thereon for rotation and chassis support. Each suspension assembly is preferably independently movable, carrying an axle and wheel thereon for controlled up and down movement to selectively raise and lower each corner of the chassis separately or in any desired combination together. Lifting motors supported on the chassis each include an output shaft connected to one corresponding suspension assembly whereby the corresponding axle and wheel thereon are carried to move up or down to effect the corresponding corner of the chassis to raise or lower in lowrider fashion. A drive motor rotatably drives at least one axle and wheel carried thereon to propel the toy vehicle. A steering motor preferably is also provided to selectively steer the front wheels.

It is therefore an object of this invention to provide a realistic miniature toy vehicle having suspension movement features which emulate a full-scale lowrider vehicle.

Still another object of this invention is to provide a relatively larger 1:6 scale toy vehicle having lowrider movement features which are achieved by realistic independent four wheel suspensions and lifting motors for each of those suspension assemblies.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
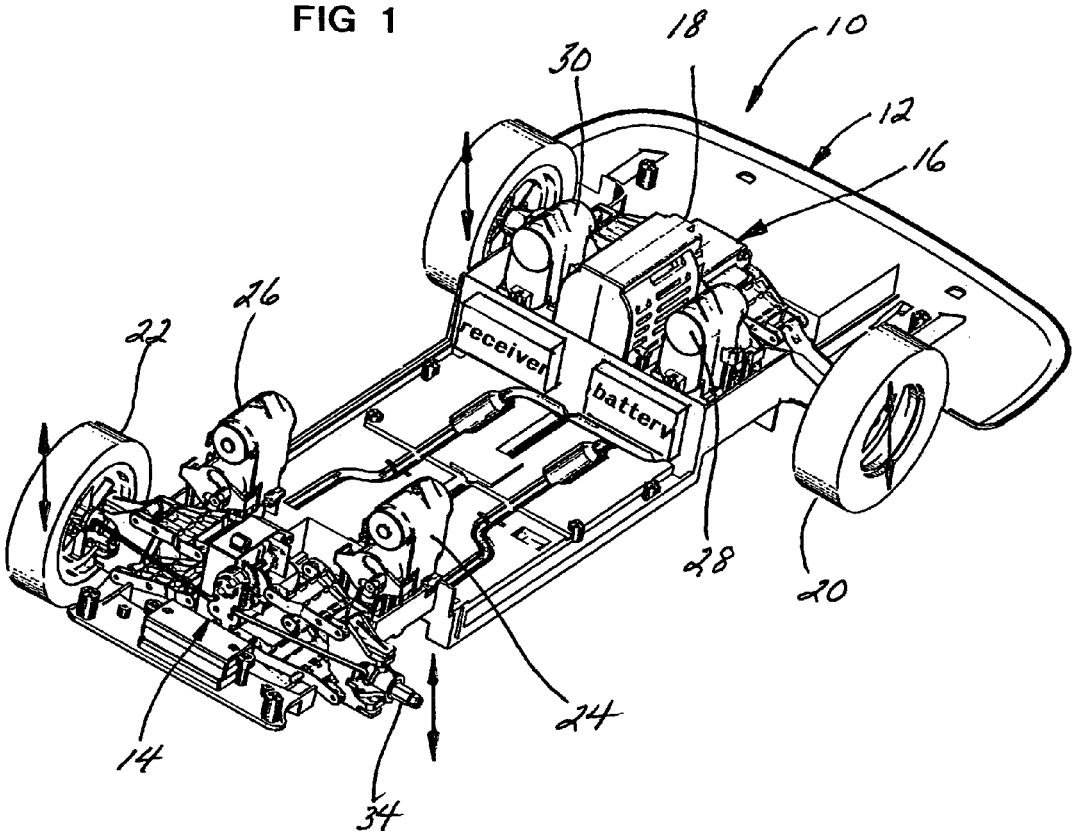
FIG. 1 is a perspective view of a toy vehicle chassis with suspension assemblies, lifting motor and wheels shown attached thereto.

Referring now to the drawings, and firstly to FIG. 1, the chassis assembly is there shown generally at numeral 10 and includes a molded plastic chassis 12, a steering motor assembly 14 and a drive motor or actuator assembly 16. A lifting motor or actuator is positioned at 24, 26, 28 and 30 in conjunction with the left front, right front, left rear, and right rear suspension assemblies, respectively, as will be described in more detail herebelow. A drive motor 18 is operably connected to the vehicle drive assembly 16 so as to drivingly rotate rear wheels 20 to propel the vehicle while the steering motor assembly 14 operably actuates laterally extending steering linkages 45 as best seen in FIGS. 2 to 4 for front wheel 22 about upright steering axes 62 and 64 to effect the pivotal positioning of front axles 34 about the steering axes 62 and 64.

Figure 2:
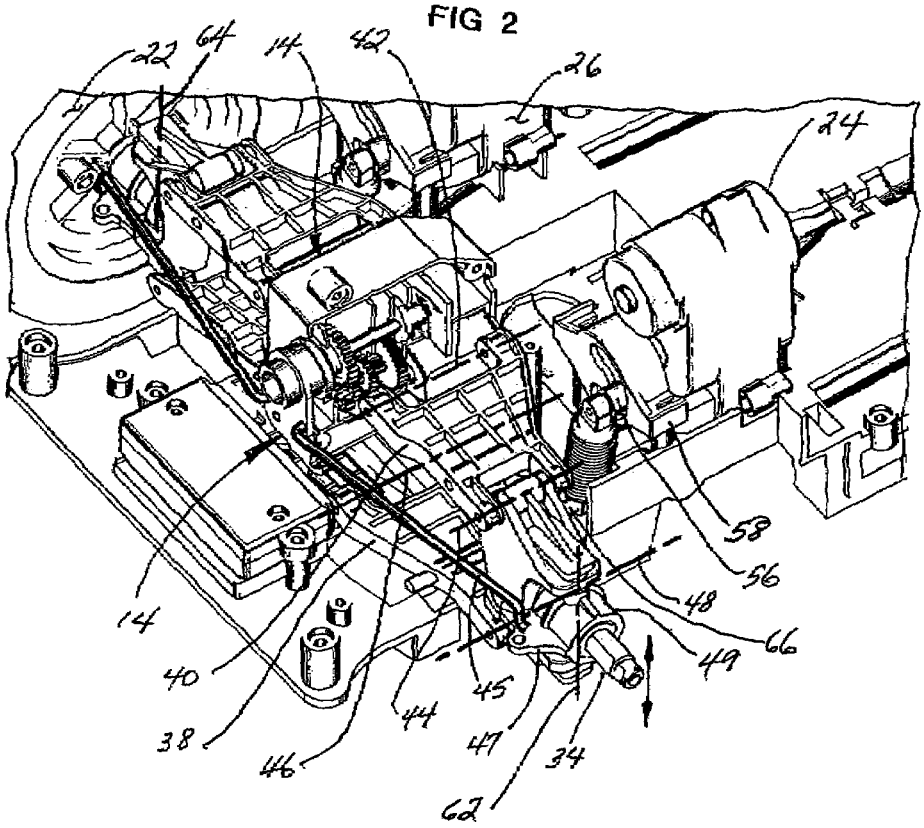
FIG. 2 is a perspective view of the front portion of the chassis and front suspension assemblies of FIG. 1.
Figure 3:
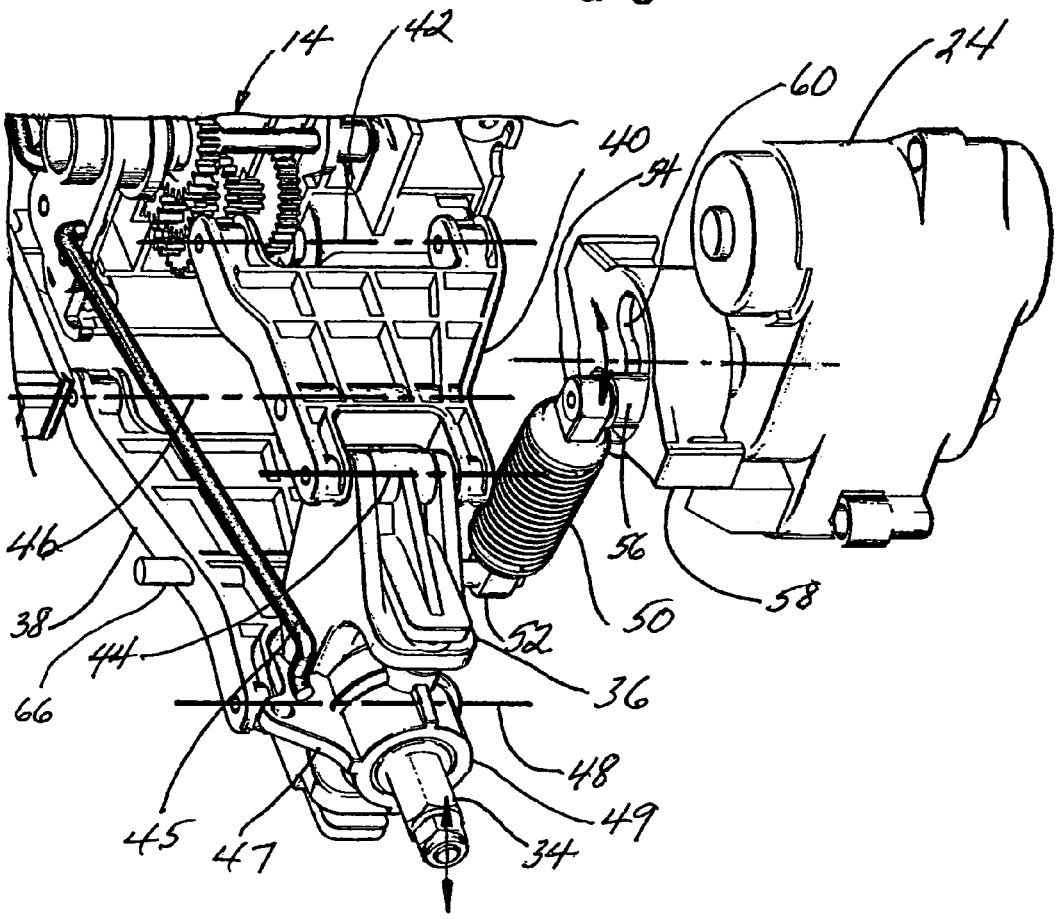
FIG. 3 is an enlargement of the right front suspension and lifting motor therefor of FIG. 2.
Figure 4:
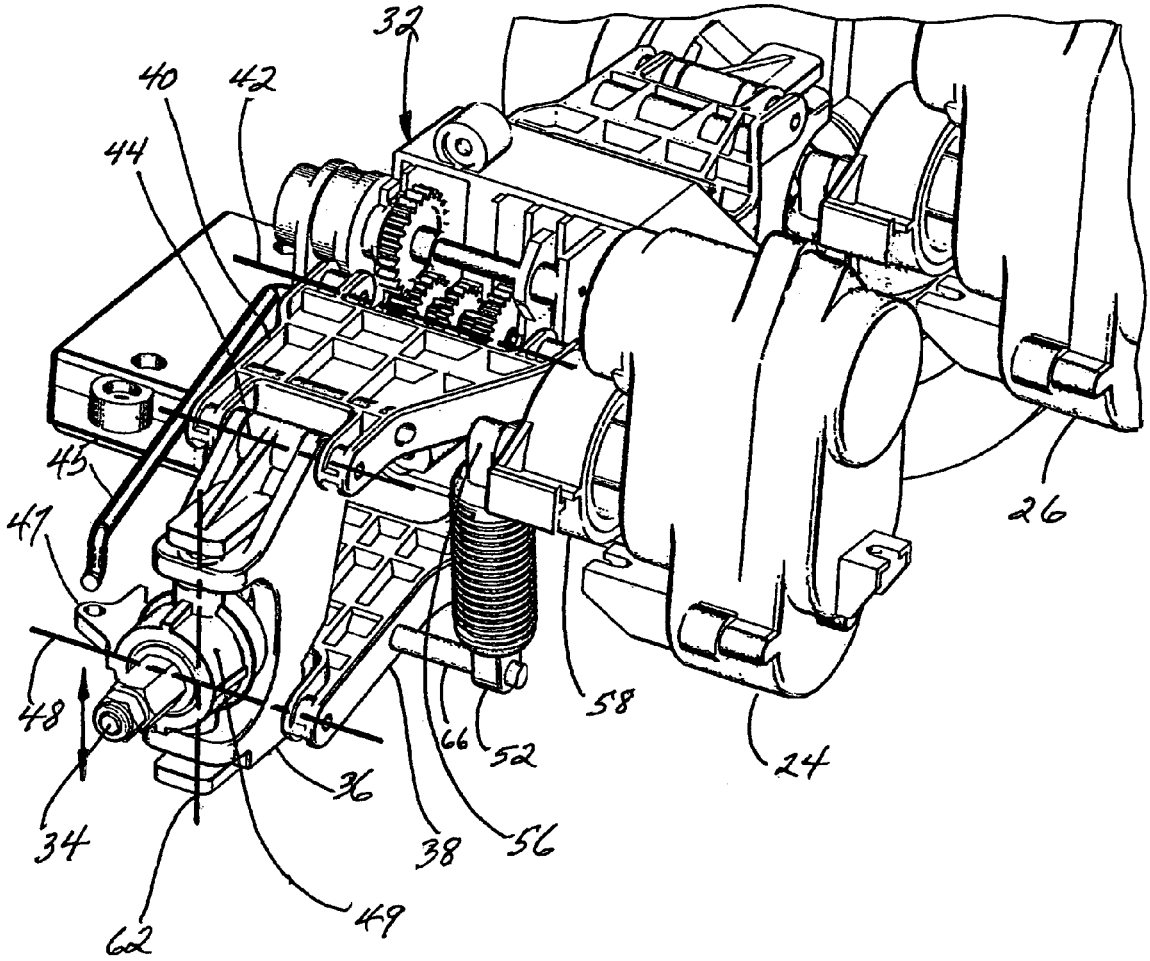
FIG. 4 is a rear perspective view of the front portion of the chassis, left front suspension assembly and lifting motor therefor of FIG. 1.

As best seen in FIGS. 2 to 4, the left and right front suspension assemblies connected to the forwardly left-hand and right-hand portions of the chassis 10, respectively, each include an upper control arm 40 and a lower control arm 38 each pivotally connected to the chassis about longitudinal parallel axes 42 and 46, respectively. A suspension steering knuckle 36 is pivotally connected to the upper and lower control arms 40 and 30, respectively, about pivotal parallel longitudinal axes 44 and 48, respectively, so that up and down movement of the suspension assembly causes the transverse axle 34 and spindle 49 to move up and down in the direction of the arrow.

To effect pivotal steering of each of the steering knuckles 36 about upright steering axes 62 and 64, the steering linkages 45, operably connected to the output of the steering motor 14 at their inner ends, are pivotally connected to the steering arm 47 of the spindle 49. By this arrangement of suspension assemblies and components therefor, full independent front suspension and steering movement replicating those of a real vehicle are achieved.

Each of the front suspension lifting motors 24 and 26 attached to the chassis about a longitudinal axes thereof includes an output shaft 56 which is eccentrically positioned with respect to the longitudinal axis of each lifting motor 24 and 26 and which moves in an arc of limited length best seen in FIG. 3. The segment of the arc of travel of the output shaft 56 is controlled by a travel limit housing 58 having an arcuate slot 60 formed therein within which the output shaft 56 moves. Thus, the output shaft 56 is determined and limited in its back and forth arcuate movement by the size and length of the limiting slot 60.

A connector link 50 is provided and is pivotally connected at an upper end thereof to the output shaft 56. The lower end of the connector link 50 is pivotally connected at 52 to a longitudinal shaft 66 rigidly connected to each of the lower control arms 38. By this arrangement, the arcuate limited movement of the output shaft 56 causes a corresponding pivotal movement of the lower and upper control arms 38 and 40 of each of the front suspension assemblies to effect the corresponding up and down movement of axle 34.

Figure 5:
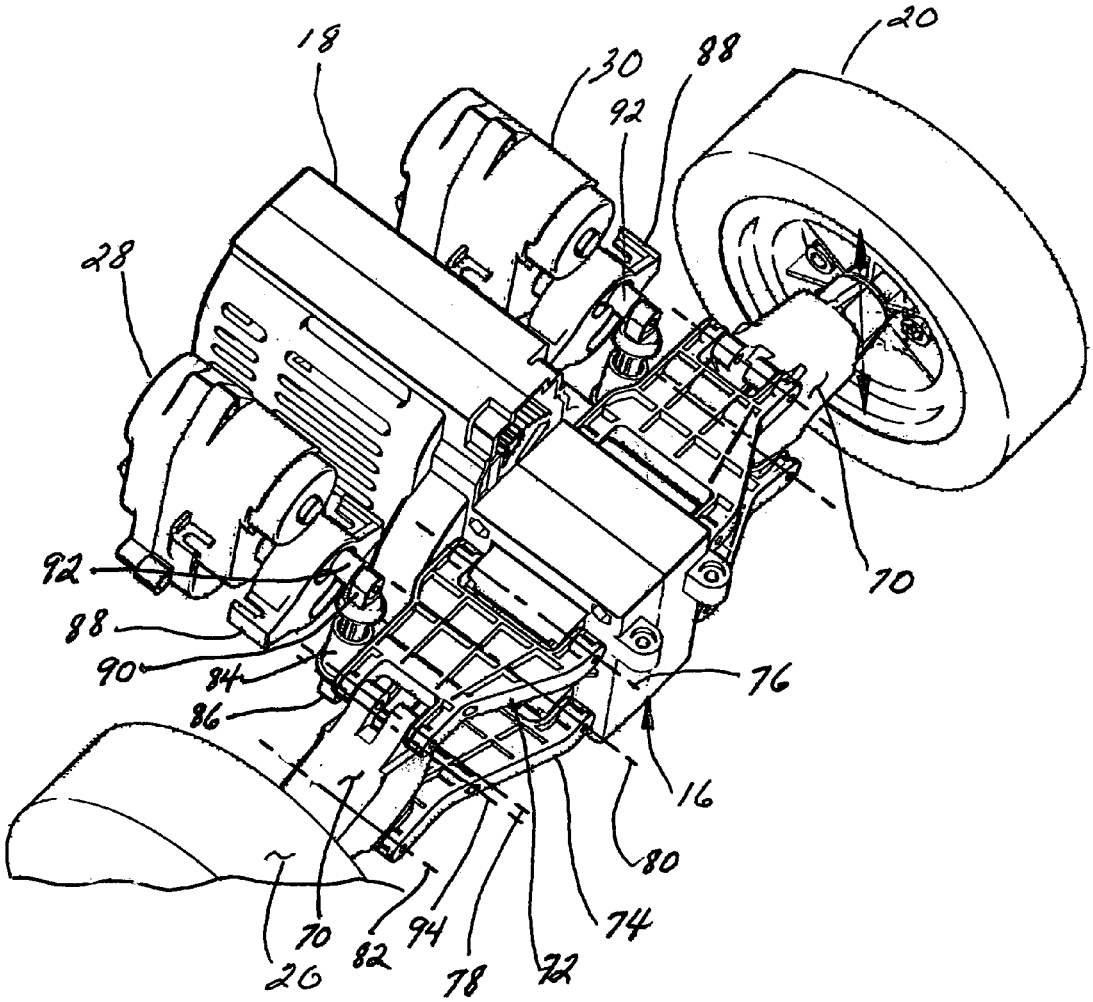
FIG. 5 is a perspective view of the rear suspension assemblies, lifting motors and drive motor of FIG. 1.

Referring now to FIG. 5, the rear suspension assemblies are connected on either side of the drive motor assembly 16 having a drive motor 18 and are secured to the rear central portion of the chassis 12. Each of the rear suspension assemblies includes an upper control arm 72 and a lower control arm 74. The upper control arm 72 is pivotally connected to the drive housing 16 about longitudinal axis 76 while the lower control arm 74 is pivotally connected the drive housing 16 about longitudinal axis 80 spaced below and parallel to axis 76. The outer ends of each of the upper and lower control arms 72 and 74, respectively, are pivotally connected about longitudinal axes 78 and 82 to an outer drive hub 70. A drive shaft (not shown) extends between the drive housing 16 and each of the drive axles (also not shown) to operably engage with and to rotatably drive rear wheels 20.

To effect vertical movement in the direction of the arrow of each of the rear wheels 20 and rear suspension assemblies, two separate right rear and left rear lifting motors 28 and 30, respectively, are also connected to the chassis 12. Output shafts 92 of each of the rear suspension lifting motors 28 and 30, as previously described, travel within arcuate slots of limited arc segment within travel limit housings 88. Connector links 84, pivotally connected at an upper end thereof 90 to the output shafts 92, transfer lifting motor output shaft movement downwardly to lower pivotal connector 86 connected to the lower control arms 74. Again, as previously described, by this arrangement, limited arcuate back and forth output shaft motions of each of the rear lifting motors 28 and 30 result in vertical lowrider-simulated movement of the rear wheels 20 in the direction of the arrow in FIG. 5.

Referring back to FIG. 1, the preferred embodiment of the invention is in the form of a wireless or radio transmitter controlled toy vehicle. To facilitate this preferred embodiment, a radio receiver and a power source in the form of a storage battery are connected to the chassis as there shown. The receiver and battery are operably connected to receive a wireless control signal from a radio transmitter (not shown) to control and operate each of the lifting motors 24, 26, 28 and 30, the steering motor assembly 14 and the drive motor assembly 16.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

I claim:

1. A toy lowrider model vehicle comprising:

a chassis having a front portion and a rear portion;

right and left front and rear suspension assemblies supported on said chassis at the right and left, front and rear portions, respectively, each of said suspension assemblies including transverse axle each supporting a wheel thereon for rotation and chassis support, each of said suspension assemblies pivotally movable to carry said axle and wheel vertically to raise and lower said chassis;

right and left, front and rear lifting motors supported on said chassis, each of which includes an eccentric output shaft which moves back and forth within an arcuate slot of a travel limit housing in a limited arc of travel about a longitudinal axis of said lifting motor, each of said output shafts being pivotally connected to one corresponding said suspension assembly whereby, when each said lifting motor is activated, the corresponding said axle and wheel thereon move up or down to cause a corresponding right or left, front or rear portion of said chassis to raise or lower;

a drive motor mounted on said chassis operably connected to rotatably drive one said axle and wheel carried thereon to propel said vehicle.

2. A model vehicle having a suspension operable to independently vary the lift of each corner portion of said vehicle, comprising:

a chassis having a front portion and a rear portion, each said portion having right and left corner portions;

right and left front and rear suspension assemblies supported on said chassis at said right and left corner portions of said front and rear portions, respectively, each of said suspension assemblies including a transverse axle supporting a wheel thereon for rotation and chassis support, each of said suspension assemblies pivotally movable to carry said axle and wheel vertically to raise and lower the respective said corner portions of said chassis;

right and left, front and rear lifting motors supported on said chassis, each said lifting motor including an eccentric output shaft which moves back and forth within an arcuate slot of a travel limit housing in a limited arc of travel about and parallel to a longitudinal axis of said lifting motor, each of said output shafts being pivotally connected to one corresponding said suspension assembly whereby, when each said lifting motor is independently activated, the corresponding said axle and wheel thereon move up or down to cause a corresponding corner portion of said chassis to raise or lower;

a drive motor mounted on said chassis operably connected to rotatably drive one said axle and wheel carried thereon to propel said vehicle.

3. A toy lowrider model vehicle comprising:

a chassis having a front portion and a rear portion, each said portion having a right and a left corner portion;

a suspension assembly supported on said chassis at each of said corner portions, each said suspension assembly including a transverse axle supporting a wheel thereon for rotation and chassis support, each of said suspension assemblies independently movable to raise and lower the respective said corner portions of said chassis;

lifting motors each supported on said chassis and including an eccentric output shaft which moves back and forth within an arcuate slot of a travel limit housing in a limited arc of travel about a longitudinal axis of said lifting motor, each of said output shafts being pivotally connected to one corresponding said suspension assembly by a connector link whereby, when each said lifting motor is selectively independently or simultaneously activated, the corresponding said corner portions raising and lowering to simulate the movements of a lowrider vehicle;

a drive motor mounted on said chassis operably connected to rotatably drive one said axle and wheel carried thereon to propel said vehicle;

a steering motor mounted on said chassis operably connected to selectively steer the front ones of said axles and wheels thereon.

* * * * *